US011377939B1

(12) United States Patent
Ye et al.

(10) Patent No.: US 11,377,939 B1
(45) Date of Patent: Jul. 5, 2022

(54) INTERLOCKING DIFFUSER ARRANGEMENT IN ELECTRICAL SUBMERSIBLE PUMP

(71) Applicant: Baker Hughes Oilfield Operations LLC, Houston, TX (US)

(72) Inventors: Zheng Ye, Claremore, OK (US); Mark Paquette, Claremore, OK (US)

(73) Assignee: BAKER HUGHES OILFIELD OPERATIONS, LLC, Houston, TX (US)

( * ) Notice: Subject to any disclaimer, the term of this patent is extended or adjusted under 35 U.S.C. 154(b) by 0 days.

(21) Appl. No.: 17/208,817

(22) Filed: Mar. 22, 2021

(51) Int. Cl.

| | |
|---|---|
| ***F04D 13/08*** | (2006.01) |
| ***E21B 43/12*** | (2006.01) |
| ***F04D 29/42*** | (2006.01) |
| ***F04D 29/66*** | (2006.01) |
| ***F04D 29/62*** | (2006.01) |
| ***F04D 29/44*** | (2006.01) |
| ***F04D 7/02*** | (2006.01) |
| *F04D 1/06* | (2006.01) |

(52) U.S. Cl.
CPC ..... *E21B 43/128* (2013.01); *F04D 7/02* (2013.01); *F04D 13/08* (2013.01); *F04D 29/4293* (2013.01); *F04D 29/445* (2013.01); *F04D 29/628* (2013.01); *F04D 29/669* (2013.01); *F04D 1/06* (2013.01)

(58) Field of Classification Search
CPC ..... F04D 13/08; F04D 29/547; F04D 13/086; E21B 43/128; E21B 43/13
See application file for complete search history.

(56) References Cited

U.S. PATENT DOCUMENTS

| | | | | |
|---|---|---|---|---|
| 8,043,051 | B2 | 10/2011 | Brunner | |
| 9,039,356 | B1 * | 5/2015 | Nowitzki | F04D 13/08 415/169.1 |
| 9,200,642 | B2 * | 12/2015 | Nowitzki | F04D 29/628 |
| 9,353,752 | B2 | 5/2016 | Tetzlaff et al. | |
| 10,533,570 | B2 | 1/2020 | Ruzicka et al. | |
| 10,533,578 | B2 * | 1/2020 | Johnson | F04D 29/628 |
| 10,683,868 | B2 * | 6/2020 | Nowitzki | F04D 29/04 |
| 2017/0102009 | A1 * | 4/2017 | Johnson | F04D 13/10 |
| 2018/0017066 | A1 * | 1/2018 | Nowitzki | F04D 29/04 |

OTHER PUBLICATIONS

U.S. Appl. No. 17/091,686, "Centralizing Features in Electrical Submersible Pump", filed Nov. 6, 2020.

* cited by examiner

*Primary Examiner* — Eldon T Brockman
(74) *Attorney, Agent, or Firm* — Bracewell LLP; Keith R. Derrington

(57) ABSTRACT

An electrical submersible well pump has upper and lower diffusers non-rotatably mounted in a housing. A rotatable impeller between the upper and lower diffusers has a bottom shroud. An outward-facing wall is on an upper end of the lower diffuser. A lower end of the upper diffuser has an inward-facing wall that fits closely around the outward-facing wall of the lower diffuser. A key mounted between the inward-facing and outward-facing walls prevents relative rotation between the diffusers. The key extends axially above an upper end of the neck and radially inward from the inward-facing wall of the upper diffuser into close proximity to the bottom shroud, creating a sand dam.

20 Claims, 2 Drawing Sheets

INTERLOCKING DIFFUSER ARRANGEMENT IN ELECTRICAL SUBMERSIBLE PUMP

FIELD OF THE DISCLOSURE

This disclosure relates in general to electrical submersible well pumps (ESP), particularly to a centrifugal pump having diffusers with an interlocking arrangement.

BACKGROUND

Electrical submersible well pumps are often used to pump well fluid from hydrocarbon producing wells. A typical ESP has a centrifugal pump with many stages, each stage having a diffuser and an impeller. The diffusers are stacked together in a pump housing and prevented from rotation. Each diffuser has a downward-facing shoulder that abuts an upward-facing shoulder of the diffuser directly below. A bearing at the top of the diffuser stack has threads that engage the pump housing, and when tightened, exert a compressive force on the stack of diffusers. The mating diffuser shoulders are perpendicular to the longitudinal axis of the pump housing.

In one type, each impeller and diffuser stage has an abrasion-resistant stage bearing that rotates with the shaft and typically transfers down thrust and up thrust to a mating diffuser. The abrasion-resistant components serve to resist abrasion when the pump is pumping sandy well fluid. Each stage bearing has a rotating component that fits within a non-rotating bushing of a mating diffuser. In another type, hubs of the impellers contact each other to transfer down thrust and up thrust to impellers above and below. The bushings and the rotating portions of the bearing that engages them are usually made of tungsten carbide. The bushings are normally pressed into a receptacle in each diffuser. To further prevent rotation an upper portion of each diffuser is staked or deformed over a top of the bushing.

The impeller and diffuser are normally castings from an iron-nickel alloy. The hardness of the alloy is much less than the hardness of the abrasion-resistant components. Making the impeller and diffuser of harder material would reduce erosion from sand-laden well fluid. However, harder material is normally more brittle. Compressing the diffusers in a stack to an extent as is done in the prior art can cause cracking. Also, staking the bushings into the diffusers creates difficulties with more brittle diffusers.

SUMMARY

An electrical submersible well pump has a tubular housing having a longitudinal axis. An upper and a lower diffuser are non-rotatably mounted in the housing. Each of the diffusers has an outer wall in close reception with an inner wall of the housing. A shaft extends through the diffusers on the axis. An impeller between the upper and lower diffusers mounts to the shaft for rotation in unison. The impeller has a bottom shroud with a skirt that fits within and engages a cavity in the lower diffuser in rotating sliding engagement. An outward-facing wall on an upper end of the lower diffuser has an outer diameter less than the outer wall of the lower diffuser, defining an upward-facing shoulder. A lower end of the upper diffuser has an inward-facing wall that fits over the outward-facing wall of the lower diffuser. The lower end of the upper diffuser abuts the upward-facing shoulder of the lower diffuser. A key mounted between the inward-facing wall and the outward-facing wall prevents relative rotation between the upper and lower diffusers. The key extends axially above an upper end of the neck and radially inward from the inward-facing wall of the upper diffuser into close proximity to the bottom shroud, creating a sand dam to retard swirling of sand-laden water surrounding the bottom shroud.

In the embodiment shown, the key has an upper end that is closer to the bottom shroud than to an upper end of the lower diffuser. The key may be rectangular when viewed in a transverse cross section.

In the embodiment shown, an inward-facing slot is formed in the inward-facing wall and an outward-facing slot is formed in the outward-facing wall. The key has an outer side that fits within the inward-facing slot and an inner side that fits within the outward-facing slot. An axial length of the key is no greater than an axial length of the inward-facing slot. The axial length of the key is greater than an axial length of the outward-facing slot.

An intake in the upper diffuser has an intake wall facing inward and converging in an upward direction. The inward-facing wall joins and extends downward from the intake wall. The inward-facing wall is cylindrical and has an axial dimension greater than an axial dimension of the outward-facing wall. The upper end of the key is below a junction between the intake wall and the inward-facing wall.

The key has an axial dimension greater than an axial dimension of the outward-facing wall. This axial dimension may be less than an axial distance from the upward-facing shoulder to the bottom shroud.

A bushing may be secured with an interference fit within a receptacle of the lower diffuser for receiving down thrust from the impeller. In the embodiment shown, an anti-rotation pin extends between the bushing and the receptacle to enhance non-rotation of the bushing relative to the lower diffuser. The receptacle has a counterbore with an upward facing base. The bushing may have an upper end with an external flange that lands on the base. In the embodiment shown, the pin is secured to and protrudes upward from the base. The flange has an aperture that receives the pin. The aperture may have an elongated circumferential dimension and a radial dimension that is less than the circumferential dimension.

DETAILED DESCRIPTION OF THE DISCLOSURE

Figure 2:
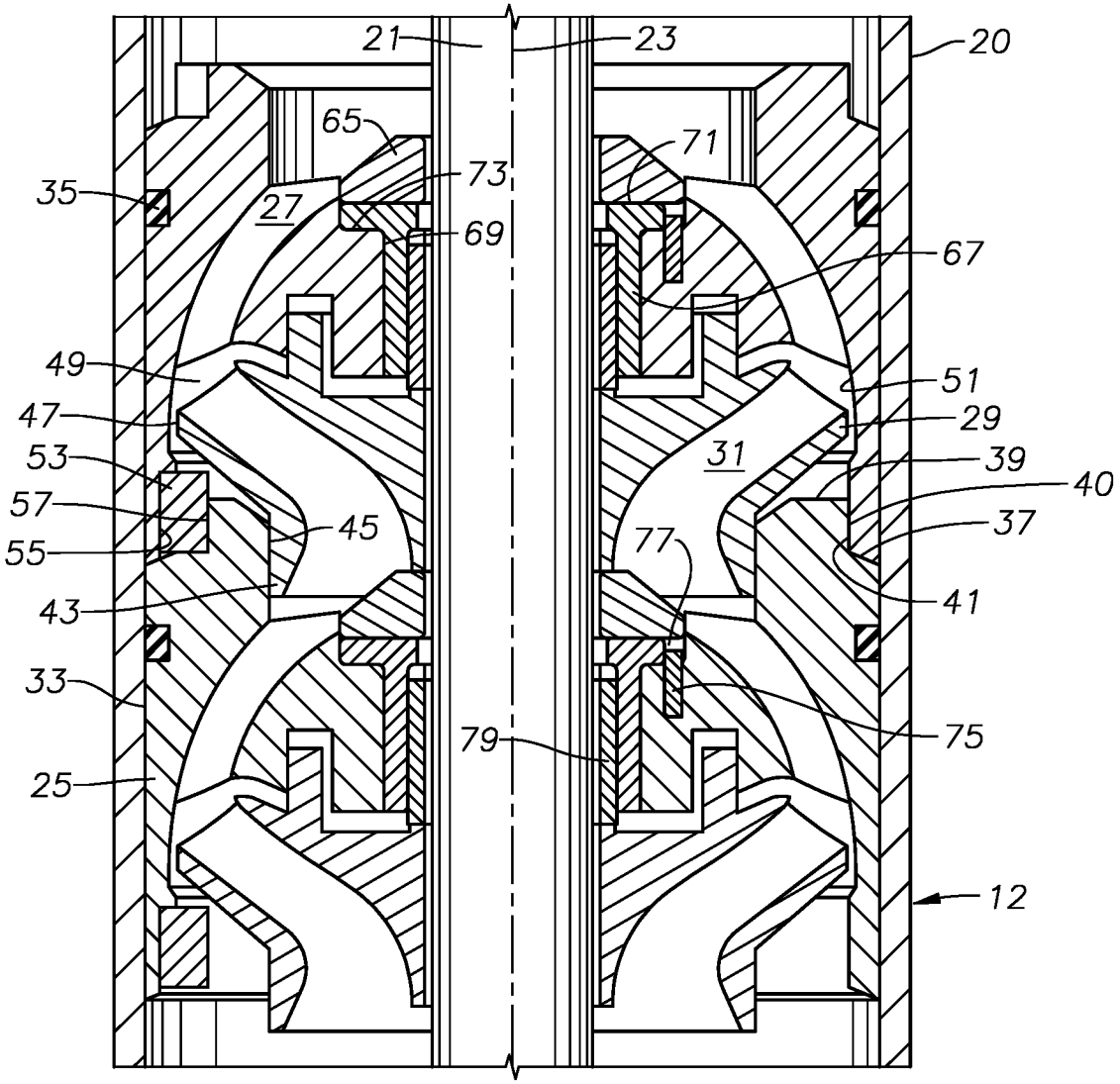
FIG. 2 is an axial sectional of two of the stages of the pump of FIG. 1.

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude. The terms "upper" and "lower" and the like bare used only for convenience as the well pump may operate in positions other than vertical, including in horizontal sections of a well.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Figure 1:
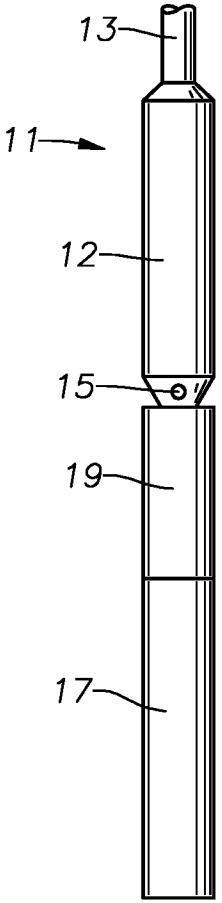
FIG. 1 is a schematic side view of an electrical submersible pump assembly in accordance with this disclosure.

FIG. 1 illustrates an electrical well pump assembly (ESP) 11 of a type typically used for oil well pumping operations. ESP 11 includes a centrifugal pump 12 having a large number of stages, each of the stages having an impeller and a diffuser. Pump 12 may be suspended in a well on a string of production tubing 13. Pump 12 has an intake 15 and discharges into production tubing 13. Alternatively, pump 12 could be suspended on coiled tubing, in which case the discharge would be in an annulus surrounding the coiled tubing.

ESP 11 also includes an electrical motor 17 for driving pump 12. Motor 17 connects to pump 12 via a seal section 19. Motor 17 is filled with a dielectric lubricant, and a pressure equalizer reduces a pressure differential between the dielectric lubricant and well fluid on the exterior. The pressure equalizer may be within seal section 19 or in a separate module. Intake 15 may be at the lower end of pump 12, in the upper end of seal section 19, or in a separate module. Also, ESP 11 may also include a gas separator, and if so, intake 15 would be in the gas separator.

Referring to FIG. 2, pump 12 has a cylindrical housing 20 with a bore through which a drive shaft 21 extends along a longitudinal axis 23. Motor 17 (FIG. 1) operatively couples to drive shaft 21 for causing drive shaft 21 to rotate.

Pump 12 has a non-rotating stack of diffusers 25 that may be identical to each other. FIG. 2 shows only two diffusers 25, but most well pumps will have many more. Each diffuser 25 has diffuser passages 27 that extend upward or downstream and curve inward relative to axis 23. An impeller 29 that rotates with shaft 21 locates between each of the diffusers 25. Diffusers 25 and impellers 29 may be manufactured with a much greater hardness than in the past, such as between 40 and 70 Rockwell C. Each impeller 29 has impeller passages 31 that extend upward and curve outward relative to axis 23. Impeller passages 31 receive well fluid from diffuser passages 27 of a next lower diffuser 25 and deliver the well fluid to diffuser passages 27 of a next upper diffuser 25. A key and slot arrangement between impellers 29 and shaft 21 causes impellers 29 to rotate with shaft 21 but allows slight upward and downward movement of impellers 29 on shaft 21.

Each diffuser 25 has an outer wall 33 that is cylindrical and fits closely within the inner diameter of housing 20. A seal ring 35 optionally fits within an annular groove in outer wall 33 for sealing engagement with the inner diameter of housing 20. Outer wall 33 has an upward facing shoulder 37 below an upper end or upper rim 39 of diffuser 25. Diffuser 25 has a cylindrical outward-facing wall or neck 40 between upward-facing shoulder 37 and upper end 39 that is smaller in diameter than diffuser outer wall 33. In this example, upward-facing shoulder 37 is a conical surface, taper or chamfer. Upward-facing shoulder 37 tapers downward or upstream and outward from neck 40 to outer wall 33.

The lower end portion of each diffuser 25 has a cylindrical inward-facing wall 41 that slides over and fits tightly around outward-facing wall 40 of the next lower diffuser 25. The lower end or lower rim of inward-facing wall 41 abuts in flush contact with upward-facing shoulder 37 of the next lower diffuser 25. In this embodiment, the lower end of inward-facing wall 41 is also a conical surface and has a taper angle that is the same as the taper angle of upward-facing shoulder 37. The axial dimension of inward-facing wall 41 is greater than the axial dimension of outward-facing wall 40 in this example.

Each impeller 29 has a skirt 43 on its lower end with a cylindrical outward-facing surface that rotates in sliding engagement with a receptacle 45 in the next lower diffuser 25. Skirt 43 is a lower portion of a bottom shroud 47, which extends upward and outward from skirt 43. This upper portion of bottom shroud 47 is conical and encloses the lower sides of impeller passages 31.

Impeller passages 31 discharge into a diffuser intake 49 that leads to diffuser passages 27. Diffuser intake 49 is a space or chamber surrounding the discharge ends of impeller passages 31 and bottom shroud 47. Diffuser intake 49 has an inward-facing intake wall 51 that is conical, converging in an upward direction. The lower end of intake wall 51 joins an upper termination of inward-facing wall 41. The upper outer end of impeller 29 is spaced closely to intake wall 51, but does not touch it.

Diffusers 25 may be stacked with a compressive force within housing 20, which tends to resist rotation relative to each other. If diffusers 25 are of a much harder material than the prior art nickel-alloy used, the amount of the compressive force should be less than previously employed to avoid cracking. In this embodiment, a plurality of keys 53 also secure diffusers 25 together to prevent rotation. Each key 53 extends between outward-facing wall 40 of the next lower diffuser 25 and inward-facing wall 41 of the next upper diffuser 25. Each key 53 protrudes above the next lower diffuser upper end 39 into diffuser intake 49 of the next upward diffuser 25. This protruding portion of key 53 also extends radially inward from diffuser inward-facing wall 41 into diffuser intake 49, creating a dam on lower diffuser upper end 39 to retard swirling of sand laden well fluid in the portion of diffuser intake 49 below impeller bottom shroud 47.

Figure 3:
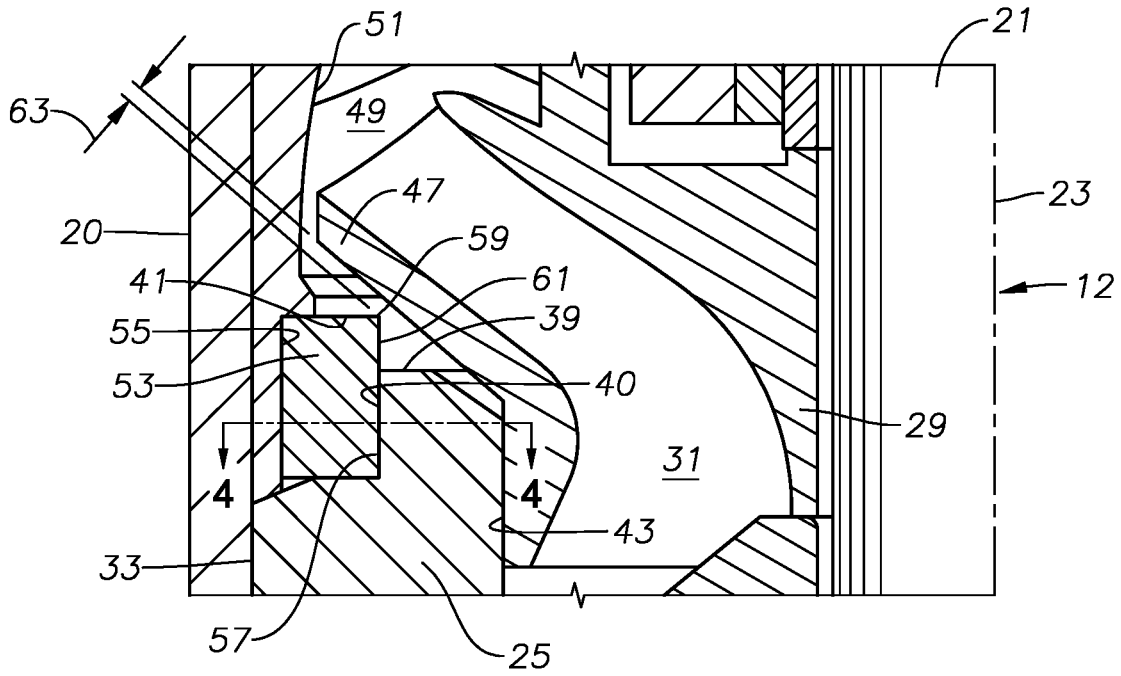
FIG. 3 is an enlarged view of a key and a portion of one of the stages of FIG. 2.
Figure 4:
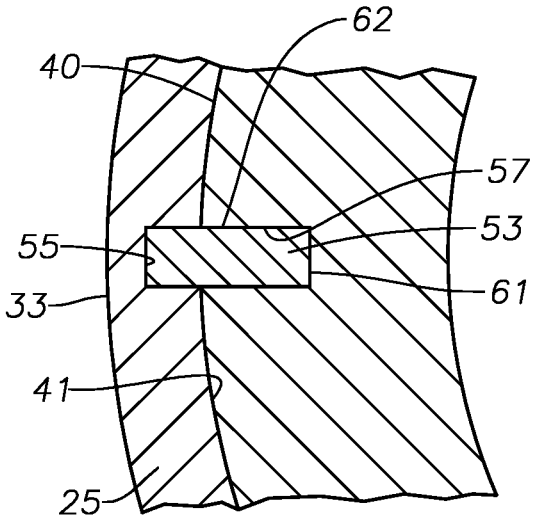
FIG. 4 is a sectional view of the key and a portion of one of the stages of FIG. 2 taken along the line 4-4 of FIG. 3.

Key 53 may be secured between inward-facing wall 41 of the next upper diffuser 25 and outward-facing wall 40 of the next lower diffuser 25 in various manners. Referring to FIGS. 3 and 4, in this embodiment, diffuser inward-facing wall 41 has an axially extending inward-facing slot 55. Outward-facing wall 40 has an axially extending outward-facing slot 57. In this example, the radial depth of inward-facing slot 55 in less than the radial depth of outward-facing slot 57, but it could be greater. The axial length of inward-facing slot 55 is slightly less than the axial length of inward-facing wall 41 and greater than the axial length of outward-facing slot 57. Outward-facing slot 57 extends from upward-facing shoulder 37 to lower diffuser upper end 39.

Key 53 has an outer portion that fits within inward-facing slot 55 and an inner portion that fits within outward-facing slot 57. Key 53 has an upper end 59 that is above the upper end of outward-facing slot 57 and in close proximity with impeller bottom shroud 47. The axial distance from diffuser upper end 39 to key upper end 59 in this example is less than the axial length of outward-facing slot 57, but it could be greater. Key upper end 59 is slightly below a junction of intake wall 51 with inward-facing wall 41. Key 53 is rectangular in this example, but the shape could differ. Key 53 has an inner edge 61 that is parallel to axis 23 and parallel to the outer side of key 53.

As shown in FIG. 4, key 53 has flat clockwise and counterclockwise sides 62 that may be parallel with each other and face into and away from the direction of rotation of impeller 29. Sand from the well fluid may accumulate against the side 62 that faces against the direction of rotation of impeller 29. Each clockwise and counterclockwise side 62 is in a plane that is slightly offset from axis 23 (FIG. 3).

The distance from inward-facing wall 41 to key inner edge 61 may be greater than the radial depth of inward-facing slot 55 so as to create a wide dam with key 53. Also, a radial dimension of key 53 from the outer portion to inner edge 61 may be more than a radial depth of either inward-facing slot 55 or outward-facing slot 57. The upper inner corner of key 53 at the junction of upper end 59 with inner side 61 is spaced from bottom shroud 47 by a small distance or gap 63. Gap 63 is much smaller than the axial distance from the upper outer tip of bottom shroud 47 to lower diffuser upper end 39.

For assembly, a slight annular clearance may exist between outward-facing wall 40 of a next lower diffuser 25 and inward-facing wall 41 of the next upward diffuser 25. During assembly, an assembler will slide the next upper diffuser 25 into engagement with the next lower diffuser 25. Key 53 will be initially installed in one of the slots 55, 57, and in this example, it is installed in inward-facing slot 55. The assembler aligns key 53 with outward-facing slot 57 and forces the next upper diffuser 25 onto the next lower diffuser 25. The conical shape of upward-facing shoulder 37 causes the next upper diffuser 25 to self-align with pump axis 23 as its conical lower end mates with shoulder 37. Axial compression may be applied to the stack of diffusers 25.

Referring to FIG. 2, a shaft bearing assembly fits within a diffuser shaft bore 69. In this embodiment, the shaft bearing assembly includes a thrust runner 65 that rotates with shaft 21 and is axially slidable relative to shaft 21 to exert down thrust from a next upper impeller 29. Thrust runner 65 slides in rotational engagement with a bushing 67 mounted in the next lower diffuser 25. Bushing 67 is secured against rotation within diffuser shaft bore 69. Bushing 67 may be press-fitted into diffuser shaft bore 69. However, if diffuser 25 is formed of a much harder material than previously used, the amount of interference should be less to avoid cracking of diffuser 25.

An anti-rotation pin arrangement may be employed in addition to an interference fit to prevent rotation of bushing 67 with diffuser shaft bore 69. In this example, bushing 67 has an upper end that is a T-shaped external flange 71 when viewed in axial cross-section for receiving down thrust from thrust runner 65. The lower side of flange 71 abuts a counterbore base 73 in diffuser 25.

The anti-rotation pin arrangement in this example includes a cylindrical pin 75 that is secured in a hole and protrudes upward from base 73. Pin 75 may be secured in the hole in base 73 in various manners. Bushing flange 71 has an aperture 77 that receives pin 75 to prevent rotation of bushing 67 in diffuser bore 69.

A bearing sleeve 79 that rotates with shaft 21 slides in rotating engagement with the inner diameter of bushing 67. Bearing sleeve 79 engages a hub of a next lower impeller 29 and may move upward relative to shaft 21 during up thrust into engagement with an inner portion of bushing flange 71 to transfer up thrust. Thrust runner 65, bearing sleeve 79 and bushing 67 may be formed of an abrasion resistant material, such as tungsten carbide, that is harder than diffusers 25 and impellers 29.

Figure 5:
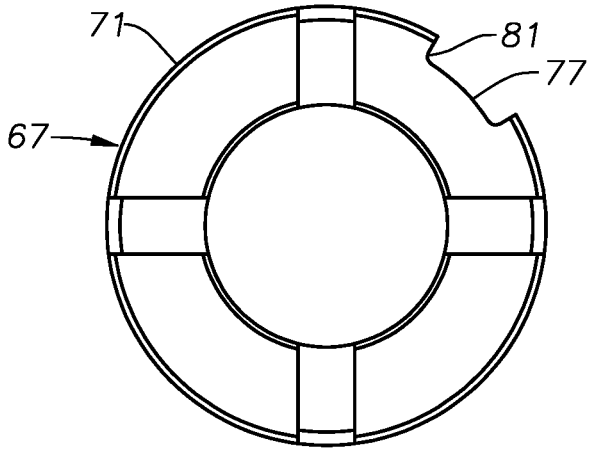
FIG. 5 is a top view of one of the bushings shown in FIG. 2.

Referring to FIG. 5, to facilitate assembly, aperture 75 is circumferentially elongated, having two ends 81 circumferentially spaced from each other a selected degree. In this example, ends 81 are about 30 degrees apart, but that could differ. Also, aperture 81 extends completely to the outer diameter of bushing flange 71, thus is open on its outer side. The radial depth of aperture 77 is much less than its circumferential length between circumferential ends 81.

During assembly, an assembler will align aperture 81 with pin 75 and press-fit bushing 67 into diffuser bore 69. The combination of the interference fit and pin 75 eliminate a need for staking or deforming portions of the lower end of diffuser bore 69 against and over portions of bushing 67, as is done in prior art techniques. Diffusers 25 may be much harder and more wear resistant than in the past because staking deformation is not required. Also, the amount of interference can be less.

The present disclosure described herein, therefore, is well adapted to carry out the objects and attain the ends and advantages mentioned, as well as others inherent therein. While only two embodiments of the disclosure has been given for purposes of disclosure, numerous changes exist in the details of procedures for accomplishing the desired results. These and other similar modifications will readily suggest themselves to those skilled in the art, and are intended to be encompassed within the scope of the appended claims.

The invention claimed is:

1. An electrical submersible well pump, comprising:

a tubular housing having a longitudinal axis;

an upper and a lower diffuser non-rotatably mounted in the housing, each of the diffusers having an outer wall in close reception with an inner wall of the housing;

a shaft extending through the diffusers on the axis;

an impeller between the upper and lower diffusers and mounted to the shaft for rotation in unison, the impeller having a bottom shroud;

an outward-facing wall on an upper end of the lower diffuser having an outer diameter less than the outer wall of the lower diffuser, defining an upward-facing shoulder;

the upper diffuser having an inward-facing wall that fits around the outward-facing wall of the lower diffuser, the upper diffuser having a lower end that abuts the upward-facing shoulder of the lower diffuser;

a key mounted between the inward-facing wall and the outward-facing wall to prevent relative rotation between the upper and lower diffusers; and wherein the key extends axially above an upper end of the outward-facing wall and radially inward from the inward-facing wall of the upper diffuser into close proximity to the bottom shroud, creating a sand dam to retard swirling of sand-laden water surrounding the bottom shroud.

2. The pump according to claim 1, wherein the key has an upper end that is closer to the bottom shroud than to the upper end of the outward-facing wall.

3. The pump according to claim 1, wherein the key is rectangular when viewed in a transverse cross section.

4. The pump according to claim 1, further comprising:

an inward-facing slot in the inward-facing wall and an outward-facing slot in the outward-facing wall; wherein the key has an outer side that fits within the inward-facing slot and an inner side that fits within the outward-facing slot;

an axial length of the key is no greater than an axial length of the inward-facing slot; and the axial length of the key is greater than an axial length of the outward-facing slot.

5. The pump according to claim 1, further comprising:

an intake in the upper diffuser with an intake wall facing inward and converging in an upward direction; wherein the inward-facing wall joins and extends downward from the intake wall, the inward-facing wall being cylindrical and having an axial dimension greater than an axial dimension of the outward-facing wall; and the upper end of the key is below a junction between the intake wall and the inward-facing wall.

6. The pump according to claim 1, wherein:

the key has an axial dimension greater than an axial dimension of the outward-facing wall and less than an axial distance from the upward-facing shoulder to the bottom shroud.

7. The pump according to claim 1, further comprising:

a bushing secured with an interference fit within a receptacle of the lower diffuser for receiving down thrust from the impeller; and an anti-rotation pin extending between the bushing and the receptacle to enhance non-rotation of the bushing relative to the lower diffuser.

8. The pump according to claim 7, wherein:

the receptacle has a counterbore with an upward facing base;

the bushing has an upper end with an external flange that lands on the base;

the pin is secured to and protrudes upward from the base; and the flange has an aperture that receives the pin.

9. The pump according to claim 8, wherein the aperture has an elongated circumferential dimension and a radial dimension that is less than the circumferential dimension.

10. An electrical submersible well pump, comprising:

a tubular housing having a cylindrical inner wall with a longitudinal axis;

an upper and a lower diffuser non-rotatably mounted in the housing;

an axially extending shaft extending through the diffusers;

an impeller between the upper and lower diffusers and mounted to the shaft for rotation in unison, the impeller having a conical bottom shroud and a cylindrical skirt depending from the bottom shroud that fits within and engages a cavity in the lower diffuser in rotating sliding engagement;

an external upward-facing shoulder on the lower diffuser;

an outward-facing wall extending upward from the upward-facing shoulder and spaced inward from the inner wall of the housing;

a lower end of the upper diffuser having an inward-facing wall that fits around the outward-facing wall of the lower diffuser, the lower end of the upper diffuser having a downward-facing rim that abuts the upward-facing shoulder;

a key mounted between the inward-facing wall and the outward-facing wall to prevent relative rotation between the upper and lower diffusers; and wherein the key extends axially above an upper end of the outward-facing wall and radially inward past the inward-facing wall toward the bottom shroud, creating a sand dam to retard swirling of sand-laden water surrounding the bottom shroud.

11. The pump according to claim 10, wherein the key has an upper end that is closer to the bottom shroud than to an upper end of the outward-facing wall of the lower diffuser.

12. The pump according to claim 10, wherein:

the key has a clockwise-facing side and a counterclockwise-facing side, considering a direction of rotation of the impeller; and the clockwise-facing side and the counterclockwise-facing side are flat and parallel with each other.

13. The pump according to claim 10, further comprising:

an intake in the upper diffuser with an intake wall facing inward and converging in an upward direction; wherein the inward-facing wall joins and extends downward from the intake wall, the inward-facing wall being cylindrical and having an axial dimension greater than an axial dimension of the outward-facing wall; and an inward-facing slot in the inward-facing wall;

an outward-facing slot in the outward-facing wall; wherein the key fits within the inward-facing slot and the outward-facing slot;

an axial length of the key is no greater than an axial length of the inward-facing slot; and an axial length of the key is greater than an axial length of the outward-facing slot.

14. The pump according to claim 10, further comprising:

an intake in the upper diffuser with an intake wall facing inward and converging in an upward direction; wherein the inward-facing wall joins and extends downward from the intake wall, the inward-facing wall being cylindrical and having an axial dimension greater than an axial dimension of the outward-facing wall; and an upper end of the key is below a junction between the intake wall and the inward-facing wall.

15. The pump according to claim 10, wherein:

the key has an axial dimension greater than an axial dimension of the outward-facing wall and less than an axial distance from the upward-facing shoulder to the bottom shroud.

16. An electrical submersible well pump, comprising:

a tubular housing having a cylindrical inner wall with a longitudinal axis;

a plurality of diffusers non-rotatably mounted in the housing;

a shaft extending through the diffusers on the axis;

a plurality of impellers, each between two of diffusers and mounted to the shaft for rotation in unison, each of the impellers having a conical bottom shroud and a depending cylindrical skirt that fits within and engages a cavity in a next lower one of the diffusers in rotating sliding engagement;

an external upward-facing shoulder on each of the diffusers;

an outward-facing wall extending upward from each of the upward-facing shoulders and spaced inward from the inner wall of the housing;

a lower end of a next upper one of the diffusers having an inward-facing wall that fits around the outward-facing wall of the next lower one of diffusers, the lower end of the next upper one of the diffusers having a downward-facing rim that abuts the upward-facing shoulder of the next lower one of the diffusers;

an axially extending outward-facing slot in the outward-facing wall of each of the diffusers;

an axially extending inward-facing slot in the inward-facing wall of each of the diffusers;

a plurality of keys, each of the keys having in inner side received within one of the outward-facing slots and an outer side received within one of the inward-facing slots to prevent relative rotation between the upper and lower diffusers; wherein each of the keys has a lower end at the upward-facing shoulder and an upper portion protruding above the outward-facing slot of the diffuser in which is carried; and the upper portion of each of the keys extends radially inward past the inward-facing wall toward the bottom shroud of a next upper one of the impellers, creating a sand dam to retard swirling of sand-laden water surrounding the bottom shroud.

17. The pump according to claim 16, wherein the upper portion of each of the keys has an upper end that is closer to the bottom shroud of the next upper one of the impellers than to an upper end of the outward-facing slot in which each of the keys is mounted.

18. The pump according to claim 16, wherein:

each of the keys protrudes from the inward-facing slot a radial distance greater than a radial depth of the inward-facing slot.

19. The pump according to claim 16, wherein:

each of the keys has a clockwise-facing side and a counterclockwise-facing side, considering a direction of rotation of the impellers; and the clockwise-facing side and the counterclockwise-facing side are flat and parallel with each other.

20. The pump according to claim 16, further comprising:

an intake in each of the diffusers with an intake wall facing inward and converging in an upward direction; wherein the inward-facing wall joins and extends downward from the intake wall, the inward-facing wall being cylindrical and having an axial dimension greater than an axial dimension of the outward-facing wall; and an upper end of each of the keys is below a junction between the intake wall and the inward-facing wall of each of the diffusers.

* * * * *